United States Patent [19]

Jean Blanc

[11] Patent Number: 4,991,526

[45] Date of Patent: Feb. 12, 1991

[54] BED PLATE INSERT AND PRESSER FOOT, EACH HAVING A GUIDE SURFACE FOR LATERALLY SUPPORTING A SEWING MACHINE NEEDLE

[76] Inventor: Ferdinand H. Jean Blanc, 201 Main St., Harrison, Id. 83833

[21] Appl. No.: 384,171

[22] Filed: Jul. 20, 1989

[51] Int. Cl.[5] ..... D05B 29/04; D05B 29/06; D05B 27/20

[52] U.S. Cl. ..... 112/227; 112/321; 112/184; 112/260; 112/254; 112/324; 112/235; 112/302; 112/303; 112/320

[58] Field of Search ..... 112/2, 10, 11, 28, 47, 112/49, 50, 60, 235, 236, 237, 239, 227, 310, 302, 262.2, 320, 321, 311, 324

[56] References Cited

U.S. PATENT DOCUMENTS

| | | | |
|---|---|---|---|
| 22,226 | 12/1958 | Bishop | 112/321 |
| 58,614 | 10/1866 | Davis | 112/310 |
| 83,492 | 10/1868 | Hancock | 112/321 |
| 270,540 | 1/1883 | Carlisle | 112/310 |
| 280,731 | 7/1883 | Fellows | 112/310 |
| 434,996 | 8/1890 | Sawtell | 112/227 |
| 494,039 | 3/1893 | Speight | 112/227 X |
| 597,663 | 1/1898 | Woodward | 112/324 X |
| 754,934 | 3/1904 | Noble | 112/310 |
| 942,090 | 12/1909 | Mack | 112/310 |
| 1,162,696 | 11/1915 | Jerram | 112/321 |
| 1,265,448 | 5/1918 | Herr | 112/321 |
| 1,795,373 | 3/1931 | Maier | 112/260 |
| 2,153,006 | 4/1939 | Roseman | 112/2 |
| 2,198,312 | 4/1940 | Lyons | 112/260 X |
| 2,577,430 | 12/1951 | Peterson | 112/227 X |
| 2,593,864 | 4/1952 | Enos | 112/260 |
| 2,837,047 | 6/1958 | Sheppard | 112/260 |
| 2,937,605 | 5/1960 | Dunn | 112/254 |
| 2,975,739 | 3/1961 | Duchan | 112/260 |
| 3,094,087 | 6/1963 | Thorne | 112/310 |
| 3,107,639 | 10/1963 | Basile | 112/324 X |
| 3,125,049 | 3/1964 | Redman | 112/227 X |
| 4,428,314 | 1/1984 | Renaud | 112/227 |
| 4,430,878 | 2/1984 | Dispennett | 112/260 X |

FOREIGN PATENT DOCUMENTS

| | | |
|---|---|---|
| 0676100 | 2/1966 | Belgium . |
| 1066080 | 9/1959 | Fed. Rep. of Germany . |
| 2742823 | 3/1979 | Fed. Rep. of Germany . |
| 0084336 | 12/1966 | Japan . |
| 0184133 | 6/1963 | Sweden . |
| 0263559 | 1/1927 | United Kingdom . |

*Primary Examiner*—6
*Assistant Examiner*—Ismael Izaguirke
*Attorney, Agent, or Firm*—Delbert J. Barnard

[57] ABSTRACT

A relatively long needle (22) is supported at the lower end of a needle bar (28). The needle bar (28) and needle (22) are moved up and down and forwardly and rearwardly. The needle bar (28) and needle (22) are moved forwardly while they are in materials (M) which are being sewed together, to in that manner advance the materials (M) stitch by stitch. The materials (M) are supported on a bed (10) which includes a slot (20) which is elongated in the direction of the stitch path. The needle (22) is received in the slot (22). A side boundary of the slot (20) provides a side guide surface (84) which is contiguous a first side of the needle (22). An upper thread (76) extends downwardly from a thread guide (110) into a side groove (86) in the first side of the needle (22), to and through a needle eye (80). A recess (82) is formed in the second side of the needle (22) above the needle eye (80). Following downward movement of the needle (22) through the materials (M), the needle (22) is moved upwardly. The first upward movement of needle (22) forms a loop (76') in the upper thread (76) laterally adjacent the recess (82). A shuttle hook moves along a path which includes the recess (82) and engages the loop (76') and moves the loop into a knot forming engagement with a lower thread (78). The side guide surface (84) prevents sideways deflection of the needle (22) away from the shuttle hook at a time when a presser foot component (32) is lifted to take pressure off of the materials (M) and allow the needle (22) to advance the materials (M) forwardly.

14 Claims, 20 Drawing Sheets

BED PLATE INSERT AND PRESSER FOOT, EACH HAVING A GUIDE SURFACE FOR LATERALLY SUPPORTING A SEWING MACHINE NEEDLE

TECHNICAL FIELD

This invention relates to sewing machines for sewing thick materials. More particularly, it relates to the provision of a side guide for the needle positioned to prevent lateral movement of the needle away from a shuttle hook, to in turn prevent the occurrence of missed stitches.

BACKGROUND ART

As is well-known, sewing machines include a needle which is driven up and down. The needle carries an upper thread downwardly through the materials which are being sewed together. Below the materials the upper thread is hooked by a shuttle hook and moved into engagement with a lower thread. The engaged threads are moved upwardly by the needle to form a stitch as the material advances forwardly the length of a stitch. A presser foot presses downwardly against the materials when the needle is moving downwardly. The presser foot is raised while the materials are moved forwardly.

Most sewing machines include a "feed mechanism" which is embedded in the bed of the sewing machine, in the region of the needle, of a type including teeth which are raised upwardly and moved forwardly at the same time to advance the material. At the end of the forward stroke the teeth are lowered away from the material and moved rearwardly to a start position. It is also known to advance the materials which are being sewed together by a forward movement of the needle after it has been moved downwardly through the materials. One known mechanism of this type is disclosed in U.S. Pat. No. 2,153,006, granted Apr. 4, 1939 to Leo Roseman.

A principal object of the present invention is to combine together within a sewing machine, a needle advance mechanism and a side support and guide for the needle adapting the machine for sewing together relatively thick materials without a loss of stitches due to sideways needle deflection. Sewing machines constructed according to the present invention are particularly suitable for use in the manufacture of thick leather goods, e.g. stirrups and saddles.

DISCLOSURE OF THE INVENTION

In basic form, the invention is in the nature of an improvement to sewing machines used for sewing together relatively thick materials as they are advanced forwardly by a forward displacement of the needle while the needle is down within the materials. The needle is long and slender and has a pointed lower end and a needle eye adjacent the lower end through which an upper thread extends from a first side of the needle to a second side. A shuttle hook engages a loop in the upper thread below the machine bed and causes engagement of the loop and a lower thread. The loop in the upper thread is engaged by the shuttle hook at a location immediately laterally adjacent the second side of the needle. According to the invention, the support for the materials, on which the materials are supported as they move passed the needle, includes a needle receiving slot which is elongated in the direction of material advancement. The support includes a side guide surface at the side of the slot which is adjacent the first side of the needle. The side guide surface is contiguous the first side of the needle. During the sewing operation, a presser foot is down on the materials while the needle is moving downwardly through the materials. The pressure of the presser foot holds the materials against movement while the needle is being moved downwardly. It is necessary to raise the presser foot and remove pressure from the materials shortly before the needle is moved forwardly to advance the materials. According to the invention, the point of the needle is received within the slot, and the first side of the needle is contiguous the side guide surface before the presser foot is raised. According to the invention, the first side of the needle is positioned next to the side guide surface prior to the presser foot being raised. As a result, contact between the first side of the needle and the side guide surface prevents lateral movement of the needle away from the shuttle hook at a time when the presser foot is raised and the shuttle hook is moving to engage the upper thread and tie it to the lower thread.

In preferred form, the side guide surface has a vertical dimension that is larger than the diameter of the needle. For example, the vertical dimension the side guide surface may be between two and three times the diameter of the needle, as a minimum.

In preferred form, the needle that is used has a relatively large diameter and a longitudinal slot extending down its first side. The upper thread extends downwardly the slot as it extends to and through the needle eye. Portions of the needle bounding the slot on the first side of the needle are contiguous the side guide surface.

In preferred form, a thread guide is provided at the lower end of the needle bar and is of a type which positions the upper thread into a position relatively close to the needle. In preferred form, the needle bar has an inclined side surface at its lower end and a circumferential groove adjacent its lower end. A split thread guide ring is snap fitted into the groove. The inclined side surface and a confronting solid portion of the ring define the thread guide.

According to an aspect of the invention, the presser foot is provided with a side guide surface which is substantially coplanar with the side guide surface on the material support. The use of the second needle guide is advantageous when sewing a quite thick stack of relatively tough material, e.g. layers of leather. The needle is guided by its contact with the side surface of the presser foot along a relatively straight course through the materials. When it enters the slot it is laterally braced both above and below the materials.

According to another aspect of the invention, the side guide surface in the material support can be built into a material support which is elevated above the bed of the machine. By way of example, an elevated support of this type can be used for sewing together the several parts of a stirrup. Edge portions of the parts are stitched together and it is these edge portions which rest on the support. The use of a support of this type provides space along side the stitch line for thicker portions of the materials.

Other objects, features and advantageous of the invention will be hereinafter described in detail as a part of the description of the best mode.

BRIEF DESCRIPTION OF THE DRAWINGS

Like reference numerals are used to designate like parts throughout the several views of the drawing, and.

BEST MODE FOR CARRYING OUT THE INVENTION

Figure 1:
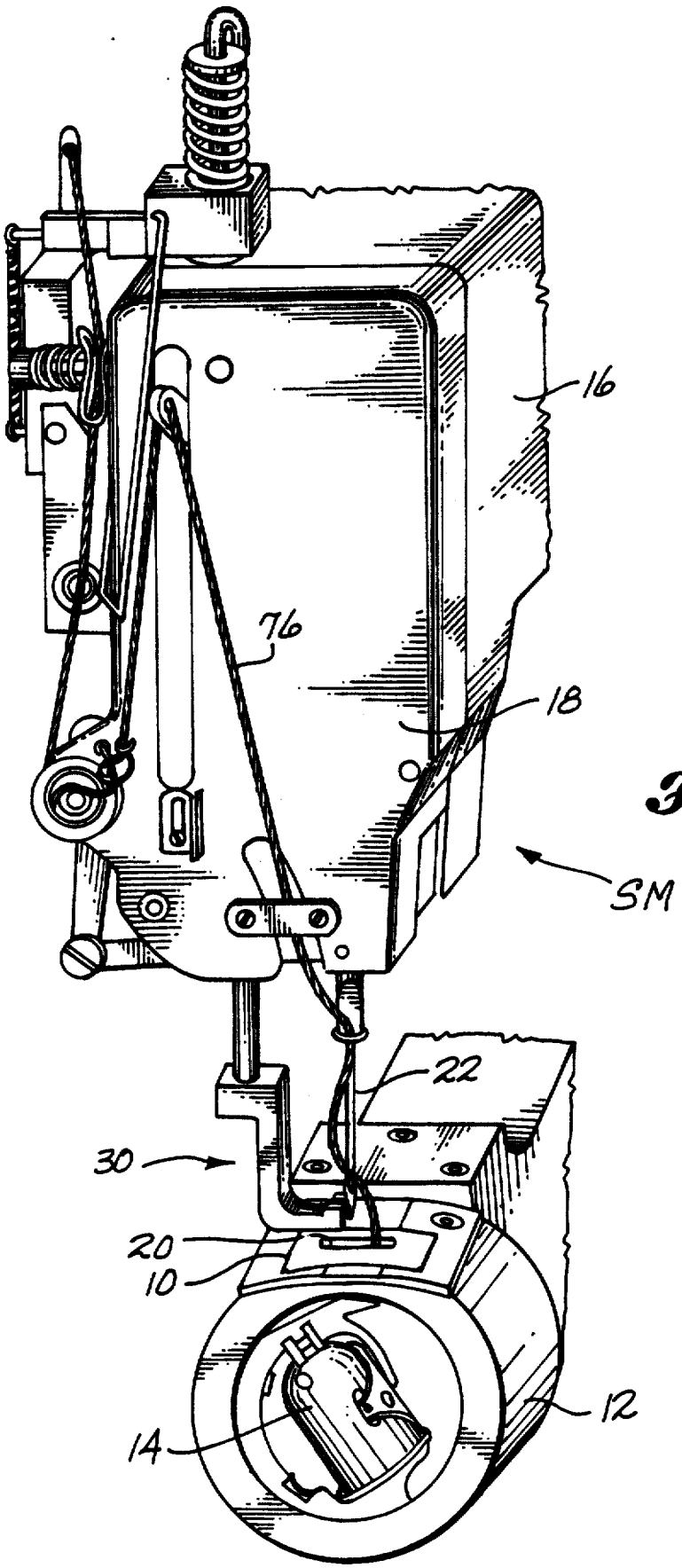
FIG. 1 is a fragmentary pictorial view of a sewing machine embodying the needle assembly and needle guide of the present invention, such view being taken from above and looking towards the needle end and an adjoining front portion of the machine, with the shuttle cover removed.

Referring to FIG. 1, a sewing machine SM is shown to include a material support 10 atop a shuttle chamber 12. A shuttle 14, the operation of which is hereinafter described, is located within the chamber 12. The sewing machine SM also includes an upper housing 16 including an end portion 18 located above the material support 10. The material support 10 includes a needle receiving slot 20 which is relatively narrow and is elongated in the direction of material advancement through the machine. A needle 22 extends downwardly towards the slot 20. The upper end portion 24 of needle 22 is secured to the lower end portion 26 of a needle bar 28. A presser foot 30 is positioned forwardly of the needle 22 in the path of material movement through the sewing machine SM. Presser foot 30 includes a lower foot portion 32 and a shank portion 34 which is connected to a presser bar 36.

Referring to FIGS. 2-6, a needle bar guide 38 is pivotally attached at its upper end, at 40, to a fixed portion of the machine housing 16. Needle bar guide 38 includes an upper bushing 42, and a lower bushing 44. The bushing provide aligned guideways in which upper and lower portions of the needle bar 28 are received. Needle bar 28, and needle 22 carried by it, are moved up and down by a needle drive which includes a drive wheel 46, a drive arm 48, and a drive block 50. The opposite ends of the drive arm 48 are pivotally connected to the drive wheel 46 and the drive block 50, respectively. In use, wheel 46 is rotated. As it rotates the arm 48 alternately pushes and pulls the drive block 50, causing the needle bar 28 to move up and down.

Upper and lower fixed portions 52, 54 of housing 16 provide axially aligned guideways 56, 58 for upper and lower portions of the presser bar 36. A collar 60 is secured to presser bar 36 above and adjacent the lower guideway 58. A compression spring 62 is positioned between an upper abutment 64 and the collar 60. The compression spring 62 biases the presser bar 36 and presser foot 30 downwardly against the materials M. In a manner known per se, and for this reason not illustrated, mechanical linkages and cams engage the presser bar 36 and move it upwardly against the force of spring 62, for the purpose of raising the presser foot 30 up off the materials M. The timing of the raising of the presser foot 30 is an important part of the invention, but the mechanism for raising the presser bar 36 is not. The particular mechanism that is preferred is a part of a commercially available sewing machine referred to as the "FERDINAND 900-B" which is available from Ferdinand, Inc. of 201 Main Street, Harrison, Idaho 83833.

Figure 2:
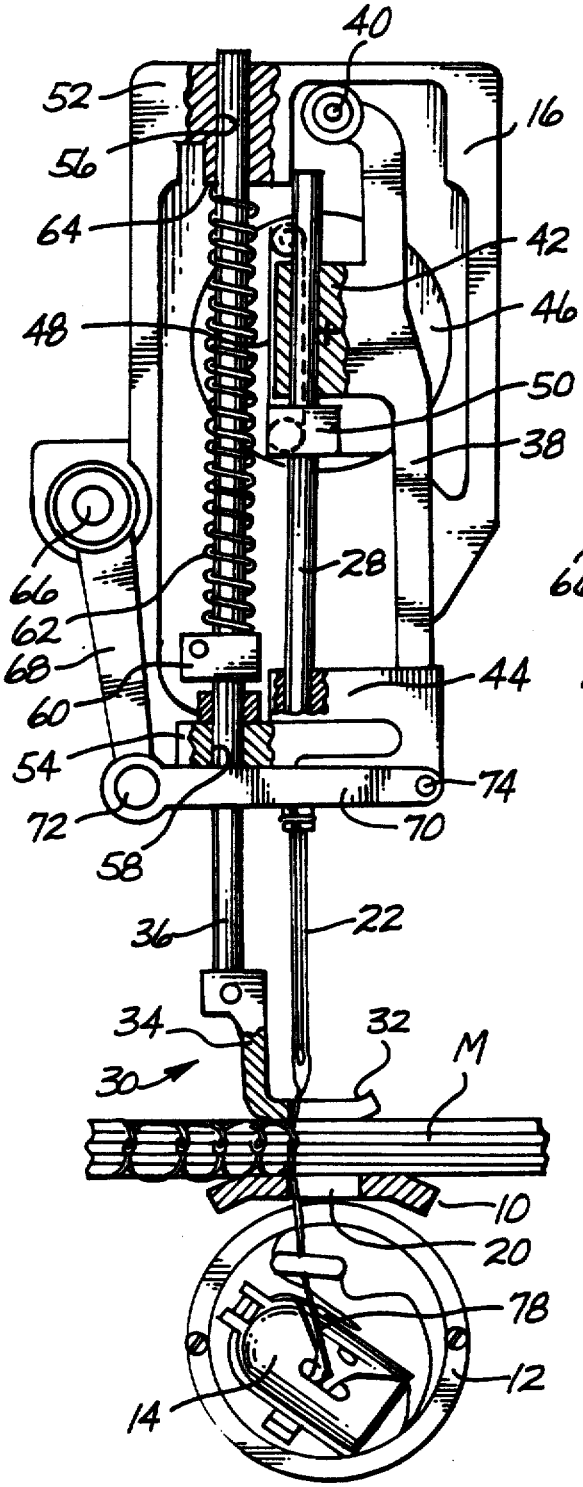
FIG. 2 is an end elevational view looking towards the needle end of the machine, with the shuttle cover removed and some upper housing structure omitted, and with some parts being shown in section, such view showing the needle elevated and in a forward position.
Figure 3:
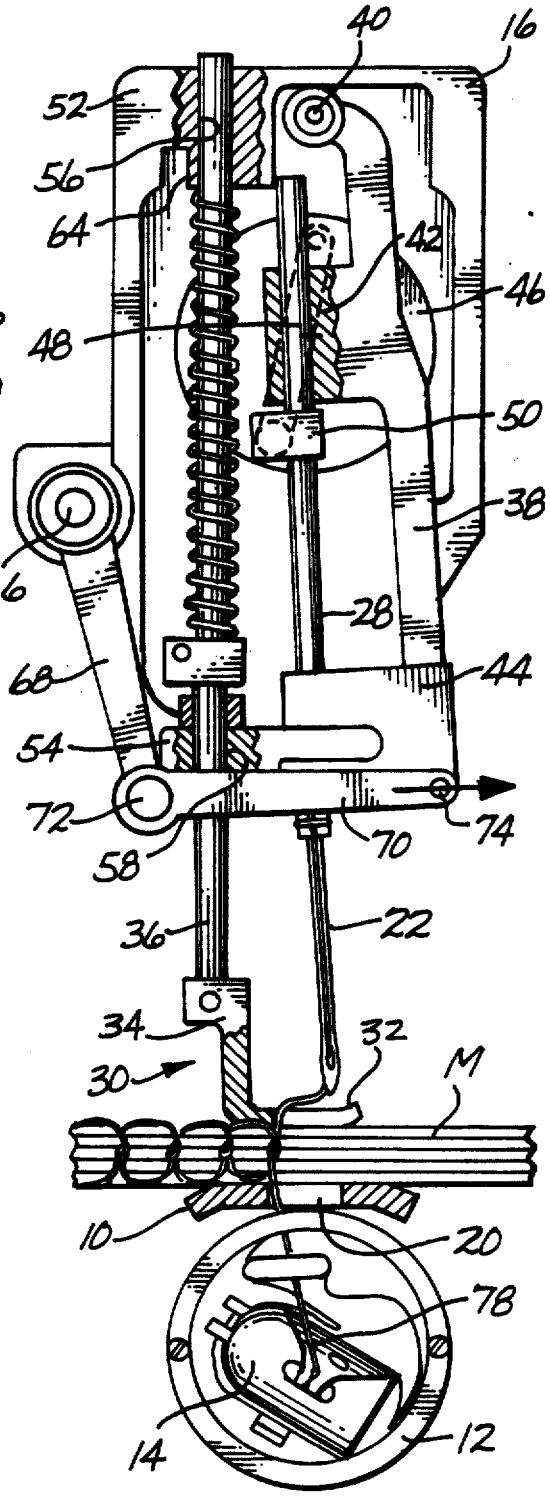
FIG. 3 is a view like FIG. 2, but showing the needle bar guide being moved rearwardly while the needle is elevated, to place the needle into a rearward start position.
Figure 4:
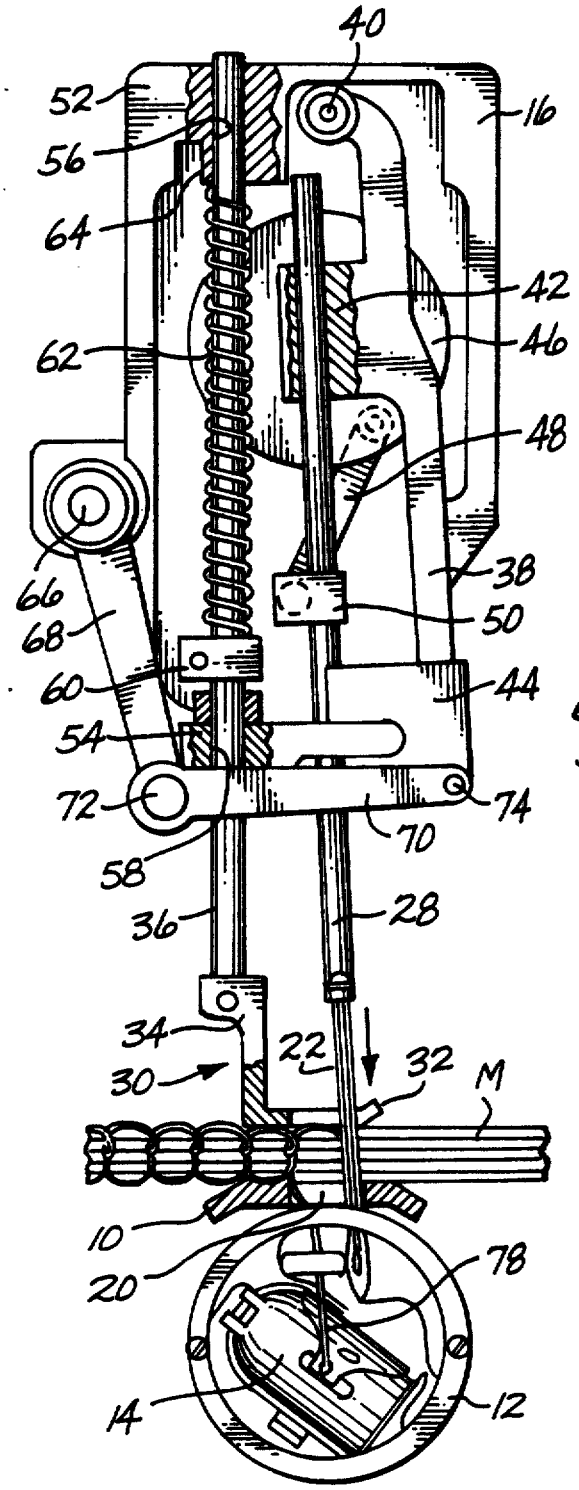
FIG. 4 is a view like FIGS. 2 and 3, showing the needle being moved downwardly, through the material being sewed.
Figure 5:
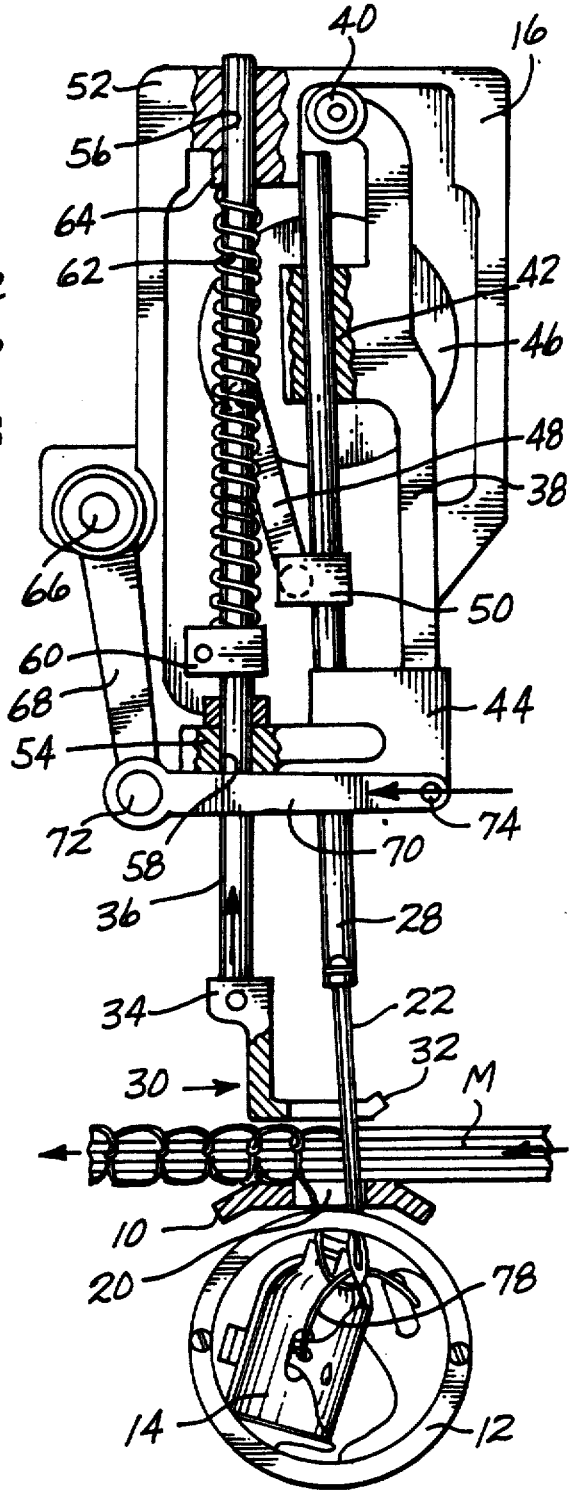
FIG. 5 is a view like FIGS. 2-4, showing the needle extending through the material and showing the start of a forward movement of the needle bar guide and needle.
Figure 6:
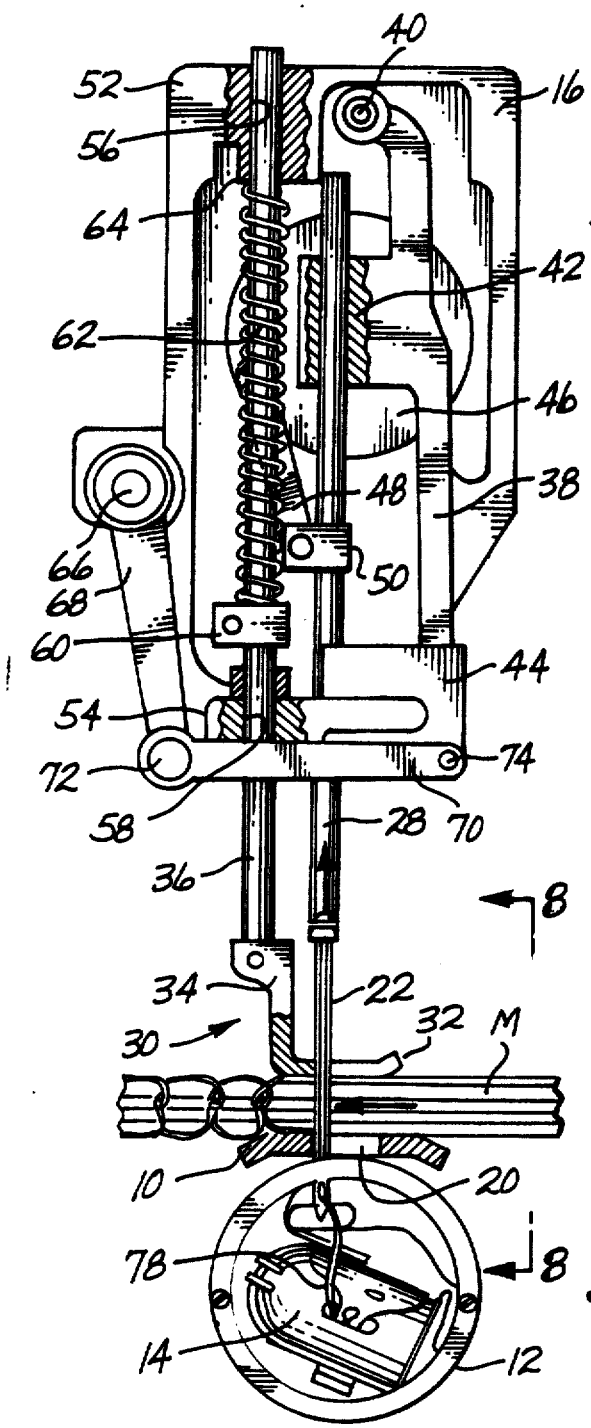
FIG. 6 is a view like FIGS. 2-5, showing the needle in a forward position and starting to move upwardly.
Figure 7:
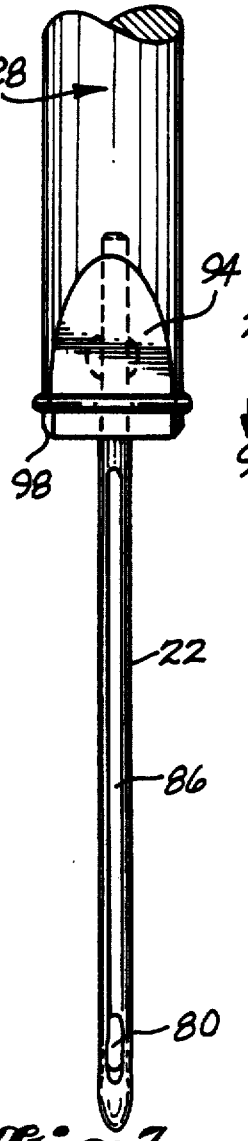
FIG. 7 is an enlarged scale elevational view of the needle and the lower end of the needle bar, taken from the same aspect as FIGS. 2-6.
Figure 8:
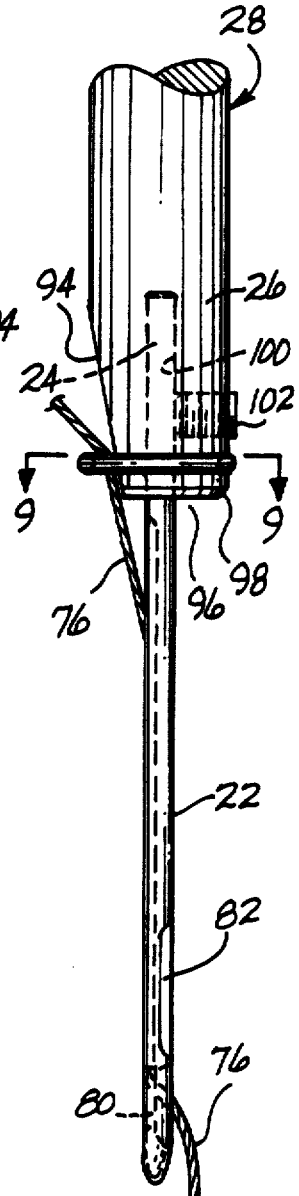
FIG. 8 is an elevational view of the needle and the needle bar taken generally from the aspect of line 8—8 in FIG. 6.

Referring to FIG. 2, the needle bar carrier 44 is shown in a forward position and the needle bar 28 and needle 22 are shown in raised positions. At this time in the sewing operation the presser foot 30 is down and the foot component 32 is exerting a clamping pressure on the materials M. This pressure holds the materials M in a fixed position on the material support 10. Then, shaft 66 is rotated for the purpose of swinging arm 68 from the position shown in FIG. 2 into the position shown in FIG. 3. Arm 68 is pivotally connected to arm 70 at location 72. Arm 70 is pivotally connected to member 44 at 74. The swinging movement of arm 68 causes an endwise displacement of arm 70 and a swinging movement of needle bar guide 38, rearwardly along the stitch path. In other words, needle 22 is swung rearwardly into a start position while it is elevated above the materials M. Next, drive wheel 46 is rotated to cause via link 48 and block 50 a downward movement of the needle bar 28 and the needle 22. This moves the needle 22 downwardly through the materials M. Next, presser foot 30 is lifted upwardly off of the materials M. FIG. 5 shows the presser foot 30 in the process of moving upwardly. According to the invention, the presser foot 30 is not raised, i.e. clamping pressure is not removed from the materials M, until at least the point portion of the needle 22 has entered the slot 20. When this happens, the presser foot 30 is raised and the drive shaft 66 is rotated in the reverse direction to cause a forward movement of the needle bar 28 and the needle 22. At this time, the needle 22 is within the materials M and hence it moves the materials M forwardly as it moves.

The needle 22 functions to move an upper thread 76 downwardly through the materials M so that it can be united with a lower thread 78. The lower thread is on a bobbin within the shuttle 14. At one stage during the sewing operation a loop is formed in the upper thread 76 on the exit side of the needle eye 80. A recess 82 is formed in this side of the needle 22. The shuttle 14 rocks back and forth and it includes a hook which moves through the recess 82 as it hooks onto the aforementioned loop in the upper thread 76. The needle 22 is relatively long. If it were to bend sideways away from the shuttle hook, the shuttle hook could miss the loop in the thread 76. If this were to happen, a stitch would be missed.

According to the present invention, the material support 10 is provided with a side guide surface 84 which is contiguous the first side of the needle 22. The first side of the needle 22 is within a plane that is very very close to the plane of the side guide surface 84. As a result, a very slight amount of sideways deflection of the needle 22 will put the first side of the needle 22 into contact with the side guide surface 84.

Figure 10:
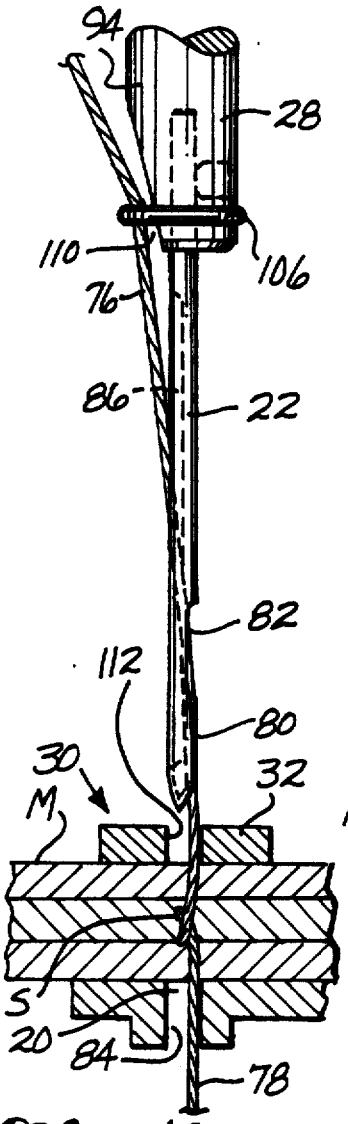
FIG. 10 is a view similar to FIG. 8, but showing the needle in a raised position relative to the material being sewed.
Figure 11:
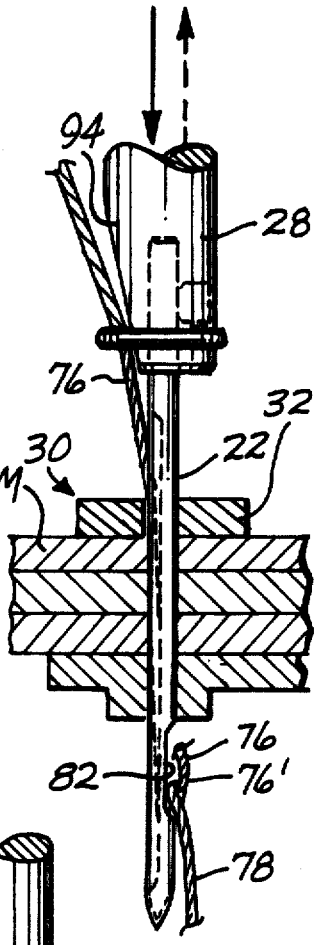
FIG. 11 is a view like FIG. 10, but showing the needle moved downwardly through the material and showing the upper thread in engagement with the lower thread.
Figure 12:
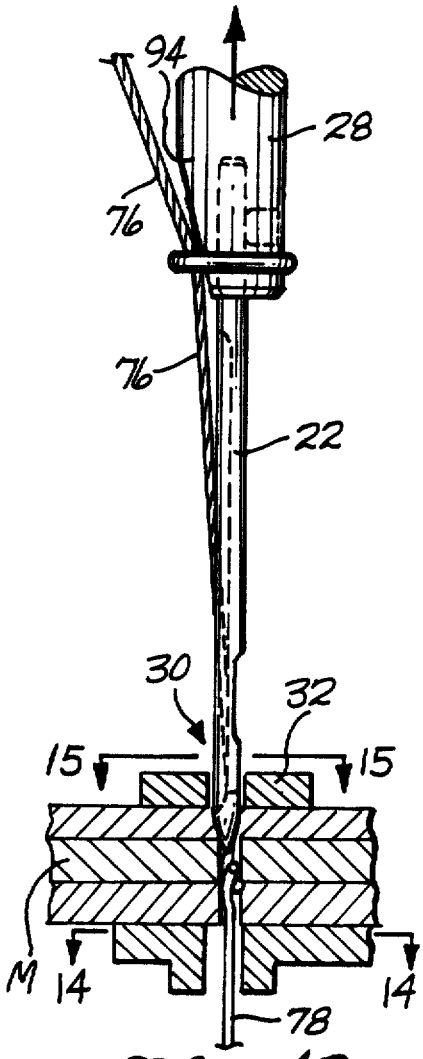
FIG. 12 is a view like FIGS. 10 and 11, showing the needle being pulled upwardly to make a stitch.
Figure 20:
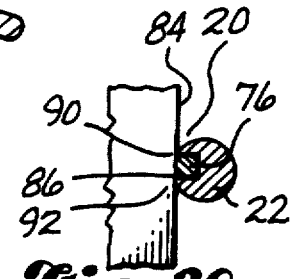
FIG. 20 is a magnified cross section view thru the needle, showing side portions of the needle which border a thread slot in the needle in contact with the side guide surface.

In preferred form, a needle 22 is used which includes a longitudinal groove 86 in its first side. As shown by FIGS. 10–12, the upper thread 76 extends downwardly through the groove 84 to and then through the needle eye 80. As best shown by FIG. 20, the thread groove 86 is bounded on its two sides by narrow border portions 90, 98 which make the contact with the surface 84. This contact is essentially a line contact and results in a very low degree of wear.

Figure 9:
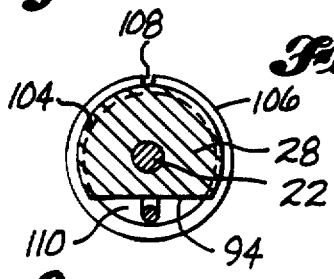
FIG. 9 is a sectional view taken substantially along line 9—9 of FIG. 8.

In preferred form, the needle bar 28 is provided with a thread guide at its lower end which functions to position the upper thread 76 closely adjacent the needle 22. A preferred thread guide forms the subject matter of my copending application Ser. No. 07/384/170, filed July 20, 1989, and entitled "Thread Guide Ring For A Needle Bar." This guide comprises an inclined side surface 94 formed on a lower portion of the needle bar 28 above the thread groove 86. The needle bar 28 is a cylindrical rod. The inclined side surface 94 serves to truncate the lower end of the rod. Needle bar 28 includes the lower end surface 96 and preferably also includes a chamfer 98 at the periphery of end surface 96. The upper end portion 24 of the needle 22 fits upwardly into an axial socket 100 formed in the lower end portion of needle bar 28. A set screw 102 is located within a threaded opening which extends perpendicular to the socket. The set screw 102 is tightened for the purpose of clamping the needle 22 to the needle bar 28. A circumferential groove 104 (FIG. 9) is formed in the lower part of the needle bar 28. A split guide ring 106 is snap fitted into the groove. Guide ring 106 includes a split 108 which is angularly spaced from the inclined surface 94. As best shown by FIG. 9, the inclined surface 94 and a confronting solid (nonsplit) portion of ring 106 defines a thread guide 110. The chamfer 98 functions to help cam the snap ring 106 onto the needle bar 28.

Referring to FIG. 10, the needle bar 28 and needle 22 are shown to be elevated above the materials M. The foot component 32 of the presser foot 30 is shown down on the materials M. The upper thread 76 is shown to extend downwardly from the guide eye 110 into and along the channel or groove 86. Upper thread 76 extends downwardly to and through the needle eye 80. Upper thread 76 and lower thread 78 are shown united at the stitch line approximately at the vertical center of the material M. FIG. 11 shows the needle bar 28 and the needle 22 after they have been moved downwardly and then back upwardly somewhat to form a loop 76' in thread 76. In this figure the lower thread 78 is shown already engaging the loop 76'. FIG. 12 shows the needle bar 28 and the needle 22 in the process of moving upwardly to complete a stitch. This upward movement occurs at the end of a forward swinging movement of the needle bar 28 and needle 22, and a resulting forward movement of the materials M a distance equal to the length of one stitch.

FIGS. 10–12 all show that the first side of the needle 22 is located within a plane that is substantially coplanar with side guide surface 84. In some installations it is desirable to use a presser foot 30 having a foot component 32 with a side guide surface 112 that is substantially coplanar with side guide surface 84. This arrangement is particularly beneficial when the sewing machine is being used for sewing through extremely thick materials M. The first side of the needle 22 runs along presser foot guide surface 112, and its direction of movement is braced against lateral bending so that the needle 22 will stay substantially straight while penetrating the materials M. When the needle 22 enters the slot 20 it is adjacent the side guide surface 84, and is prevented from moving sideways when the presser foot 30 is raised.

Figure 13:
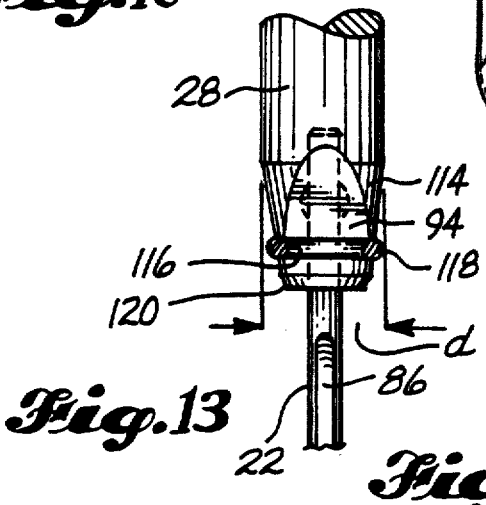
FIG. 13 is a view similar to FIG. 7, but showing the needle bar with a reduced diameter lower end portion.

FIG. 13 shows a modified construction of the thread guide at the lower end of the needle bar 28. In this embodiment the lower end portion 114 of the needle bar 28 is first tapered. Then, the inclined side surface 94 is provided. As in the first embodiment, a peripheral groove 116 is provided in the tapered region 114 adjacent the lower end of bar 28. A snap ring 118 is positioned within the groove. As before, a campher 120 is provided to help cam the ring 118 into the groove. In FIG. 13, the diameter of the presser bar 28 is designated "d". The outside diameter of guide ring 118 is shown to be smaller than diameter or "d". This construction provides a thread guide eye which is closer to the needle 22 than guide eye 110 and also allows movement of ring 118 upwardly into the guide structure for the needle bar 28, if such should be desired.

Figure 14:
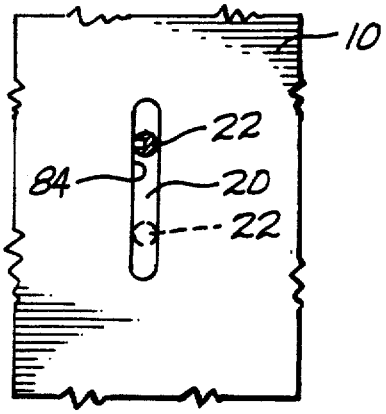
FIG. 14 is a sectional view taken substantially along line 14—14 of FIG. 12.
Figure 15:
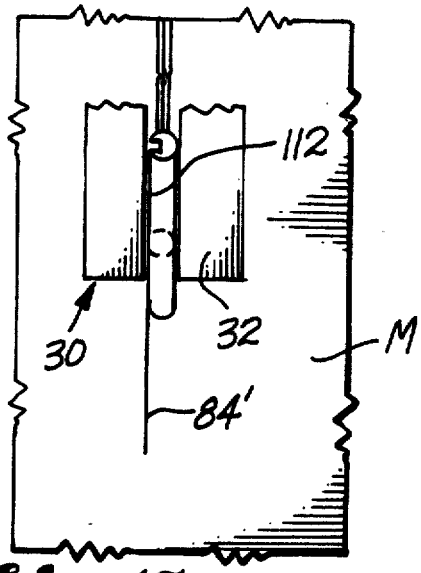
FIG. 15 is a sectional view taken substantially along line 15—15 of FIG. 12.

FIG. 14 is a top plan view of the slot 20. This view includes a broken line showing of the needle 22 in its "start" position and a solid line showing of the needle 22 in its "advanced" position. In the embodiment shown by FIG. 14 the slot 20 is formed in the bed plane or bed member 10. FIG. 15 is a view like FIG. 14 but taken immediately above the foot component 32. This view shows the side guide surface 112 to be substantially coplanar with the side guide surface 84. In this view the plane of the side guide surface 84 is indicated by a line which has been designated 84'.

Figure 16:
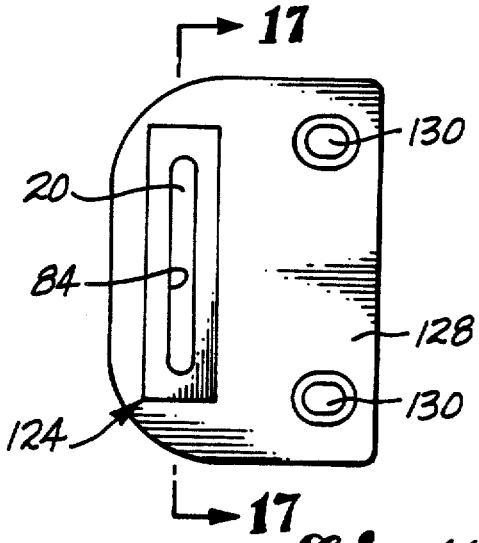
FIG. 16 is a top plan view of a bed plate which includes one embodiment of needle side guide, in the form of an insert into the bed plate.
Figure 17:
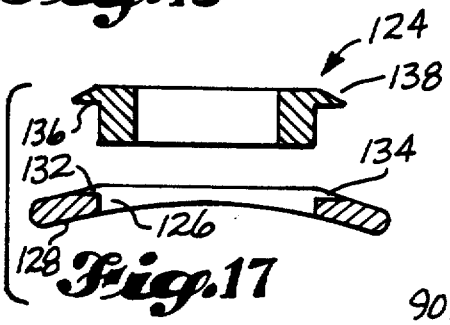
FIG. 17 is a sectional view taken substantially along line 17—17 of FIG. 16, with the insert spaced above its position in the bed plate.

FIGS. 16 and 17 show the needle guide slot 20, and the side guide surface 84, as parts of an insert 124 which is press fitted into an opening 126 formed in a bed plate 128. Bed plate 128 includes a pair of screw openings 130 which may be slightly elongated in a direction perpendicular to the slot 20. This allows a slight amount of adjustment of the plate 128, for the purpose of adjusting the position of side guide surface 84. This feature allows the side guide surface 84 to be repositioned to compensate for diameter differences in needles, for example. Clamp screws are inserted through the openings 130 and are screwed into openings formed in the machine frame below the bed plate 128.

The opening 126 may be equal in width to the insert 124. Seats 132, 134 are formed in the bed plate 128 at opposite ends of the opening 126. These seats are surfaces which have been recessed downwardly from the top surface of the plate 128. The insert 124 may include end portions 136, 138 which set down into the recesses. The upper surface of the insert 124, in the end regions 136, 138, may substantially merge with the upper surfaces of the bed plate 128, endwise of the opening 128.

Figure 18:
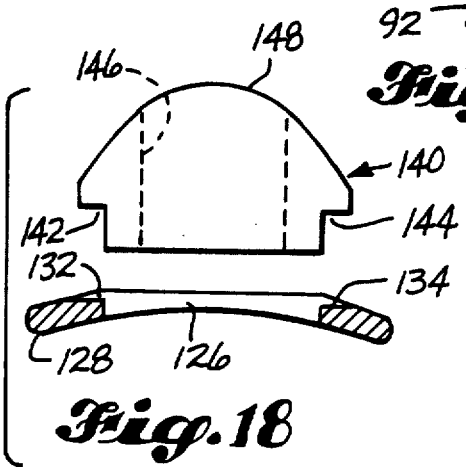
FIG. 18 is a view like FIG. 17, but of a modified construction of the insert, such insert having a raised portion above the bed plate.
Figure 19:
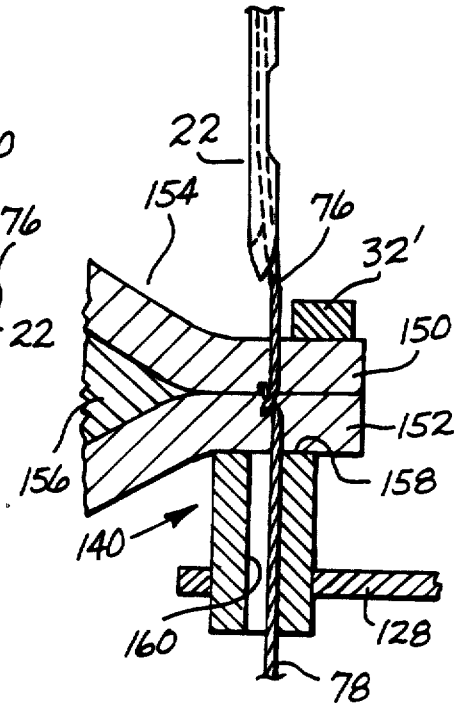
FIG. 19 is a view similar to FIG. 10, but with the upper portion of the needle and the lower portion of the needle bar omitted, such view including a sectional view of the material support shown by FIG. 18, such section being taken substantially along line 19—19 of FIG. 18.

FIGS. 18 and 19 illustrate a modified insert 140. The bed plate 128 is not changed. The insert 140 has a width equal to the width of opening 128. It includes end portions or shoulders 142, 144 which set down onto the recessed surfaces 132, 134. In this embodiment the slot 146 is elongated in the manner of slot 120. However, the vertical height of the slot is quite large (FIG. 16). Insert 140 has an upper surface 148 which is laterally straight but in the direction of the stitch line is convex. FIG. 19 shows the insert 140 being used for stitching together edge portions 150, 152 of the outer layers of a stirrup 154. The stirrup 154 includes a core 156 which makes it thicker inwardly of the edges 150, 152 than it is at the edges. The insert 140 provides an elevated support surface 158 on which the edge portions may be supported as the stirrup is being moved relative to the needle 22. The thicker portion of the stirrup is accommodated in the space which exists outwardly of insert 140 and below the support surface 150. Insert 140 includes a side guide surface 160 which is positioned substantially at the same location as side guide surface 84 in the insert 124. In this embodiment, the presser foot component 32' includes only one toe and it is positioned on the second side of the needle 22.

It is to be understood that the above-described embodiments are merely examples of the invention. Coverage is not to be determined by the examples but rather by the claims which follow, interpreted in accordance with established rules of patent claim interpretation, including use of the doctrine of equivalents.

What is claimed is:

1. In a sewing machine wherein relatively thick materials are sewed together as they are advanced forwardly by a forward displacement of a sewing machine needle while the needle is within the materials, and a shuttle hook delivers a lower thread into engagement with an upper thread at a particular lowered position of the needle, the improvement comprising:

said needle being long and shelter having a pointed lower end and a needle eye adjacent said lower end wherein the upper thread extends through the needle eye from a first side of the needle to a second side;

wherein the lower thread is brought into engagement with the upper thread immediately laterally adjacent the second side of the needle;

a support for the materials, said support including a bed plate having an insert receiving opening and recessed surfaces endwise outwardly from both ends of the insert receiving opening, and an insert insertable into the insert receiving opening, said insert including opposite end portions receivable said recessed surfaces and a needle receiving slot elongated in the direction of material advancement;

a presser foot forwardly of the needle in the path of material movement, said presser foot including a foot portion engageable on the materials and exerting a downward pressure on the materials when said materials are stopped, and raised up away from the materials when the needle is moving forwardly to in turn move the materials forwardly;

said insert also including a side guide surface at a side of the slot said guide surface adjacent the first side of the needle, said side guide surface being contiguous the first side of the needle; and wherein the presser foot is pressing on the materials while the needle is moving downwardly through the materials and the presser foot is raised after the pointed end of the needle enters into the slot;

whereby the side guide surface braces the needle against lateral movement away from the shuttle hook as the needle continues to move downwardly and then upwardly and the shuttle hook rotates to bring the lower thread into engagement with the upper thread.

2. The sewing machine of claim 1, wherein the side guide surface has a vertical dimension that is larger than the diameter of the needle.

3. The sewing machine of claim 1, wherein the needle includes a longitudinal thread receiving slot on said first side, wherein said upper thread extends downwardly through said slot to and through the needle eye, and wherein portions of the needle bounding said slot on the first side of the needle are contiguous the side guide surface.

4. The sewing machine of claim 3, wherein the needle is mounted at the lower end of a needle bar and a thread guide is provided at the lower end of the needle bar, for bringing the upper thread into a position relatively close to the needle.

5. The sewing machine of claim 4, wherein said needle bar has an inclined side surface at said lower end and a circumferential groove adjacent said lower end, and a split thread guide ring is snap fitted into said groove, and wherein said inclined side surface and a confronting solid portion of the ring define said thread guide.

6. The sewing machine of claim 1, wherein the presser foot has a needle guide surface substantially coplanar with the side guide surface on the insert.

7. The sewing machine of claim 6, wherein the needle includes a longitudinal thread receiving slot on said first side, wherein said upper thread extends downwardly through said slot to and thru the needle eye, and wherein portions of the needle bounding said slot are contiguous the side guide surface on the insert.

8. The sewing machine of claim 7, wherein the needle is mounted at the lower end of a needle bar and a thread guide is provided at the lower end of the needle bar, for bringing the upper thread into a position relatively close to the needle.

9. The sewing machine of claim 8, wherein said needle bar has an inclined side surface at said lower end and a circumferential groove adjacent said lower end, and a split thread guide ring is snap fitted into said groove, and wherein said inclined side surface and a confronting solid portion of the ring define said thread guide.

10. The sewing machine of claim 1, wherein said insert has upper surface portions endwise outwardly from the slot, said portions are substantially a continuation of upper surface portions of said bed plate in the regions endwise of the insert receiving opening.

11. The sewing machine of claim 1, wherein said insert includes a portion extending upwardly above the bed plate, said portion including an upper material supporting surface.

12. The sewing machine of claim 11, wherein said upper material supporting surface is of convex curvature in the direction of the slot.

13. In a sewing machine wherein relatively thick materials are sewed together as they are advanced forwardly by a forward displacement of a sewing machine needle while the needle is within the materials, and a shuttle hook delivers a lower thread into engagement with an upper thread at a particular lowered position of the needle, the improvement comprising:

said needle being long and slender having a pointed lower end and a needle eye adjacent said lower end wherein the upper thread extends through the needle eye from a first side of the needle to a second side;

wherein the lower thread is brought into engagement with the upper thread immediately laterally adjacent the second side of the needle;

a support for the materials, said support including a needle receiving slot elongated in the direction of material advancement;

a pressure foot forwardly of the needle in the path of material movement, said presser foot including a foot portion engageable on the materials and exerting a downward pressure on the materials when they are stopped, and raised up away from the materials when the needle is moving forwardly to in turn move the materials forwardly;

said support includes a side guide surface at a side of the slot which is, said guide surface adjacent the first side of the needle, said side guide surface being contiguous the first side of the needle and having a vertical dimension that is larger than the diameter of the needle;

wherein the presser foot includes a needle guide surface substantially coplanar with the side guide surface on the support and said presser foot is pressing on the materials while the needle is moving downwardly through the materials and the presser foot is raised after the pointed in of the needle enters into the slot;

whereby the side guide surface of the support braces the needle against lateral movement away from the shuttle hook as the needle continues to move downwardly and then upwardly and the shuttle hook rotates to bring the lower thread into engagement with the upper thread;

wherein the needle is mounted at the lower end of a needle bar and a thread guide is provided at the lower end of the needle bar, for bringing the upper thread into a position relatively close to the needle; and wherein said needle bar has an inclined side surface at said lower end and a circumferential groove adjacent said lower end, and a split thread guide ring is snap fitted into said groove, and wherein said inclined side surface and a confronting solid portion of the ring define said thread guide.

14. The sewing machine of claim 13 wherein the needle includes a longitudinal thread receiving slot on said first side, wherein said upper thread extends downwardly through said slot to and through the needle eye, and wherein portions of the needle bounding said slot are contiguous the side guide surface on the support.

* * * * *

UNITED STATES PATENT AND TRADEMARK OFFICE

CERTIFICATE OF CORRECTION

PATENT NO. : 4,991,526

DATED : February 12, 1991

INVENTOR(S) : Ferdinand H. JeanBlanc

It is certified that error appears in the above-identified patent and that said Letters Patent is hereby corrected as shown below:

On the title page, second column, beneath the Abstract, "20 Drawing Sheets" should be -- 6 Drawing Sheets --.

Col. 1, line 65, "passed" should be -- past --.

Col. 2, line 23, after "dimension", insert -- of --.

Col. 2, line 62, "advantageous" should be -- advantages --.

Col. 3, line 50, after "of", insert -- a --.

Col. 3, line 65, "thru" should be -- through --.

Col. 4, lines 24 and 25, "bushing" should be -- bushings --.

Col. 5, line 35, "very very" should be -- very, very --.

Col. 6, line 51, "campher" should be -- chamfer --.

Claim 1, col. 7, line 64, "shelter" should be -- slender --.

Claim 1, col. 8, line 9, after "receivable", insert -- in --.

Claim 1, col. 8, line 21, there should be a comma after "slot".

Claim 7, col. 8, line 61, "thru" should be -- through --.

UNITED STATES PATENT AND TRADEMARK OFFICE

CERTIFICATE OF CORRECTION

PATENT NO. : 4,991,526

DATED : February 12, 1991

INVENTOR(S) : Ferdinand H. JeanBlanc

It is certified that error appears in the above-identified patent and that said Letters Patent is hereby corrected as shown below:

Claim 13, col. 9, line 26, after "slender", insert -- and --.

Claim 13, col. 9, line 37, "pressure foot" should be -- presser foot --.

Claim 13, col. 10, line 5, delete "which is".

Claim 13, col. 10, line 15, "in" should be -- end --.

Signed and Sealed this

Tenth Day of December, 1996

*Attest:*

*Attesting Officer*

Bruce Lehman

BRUCE LEHMAN

*Commissioner of Patents and Trademarks*